US005088738A

United States Patent [19]

Mundt et al.

[11] Patent Number: 5,088,738

[45] Date of Patent: Feb. 18, 1992

[54] PENDULUM PUTTING DEVICE

[76] Inventors: Henry W. Mundt; Virginia C. Mundt, both of 2640 W. Camino Del Grijalva, Tucson, Ariz. 85741

[21] Appl. No.: 750,461

[22] Filed: Aug. 27, 1991

[51] Int. Cl.[5] ..... A63B 69/36; A63B 53/14

[52] U.S. Cl. ..... 273/193 B; 273/165; 273/81.2; 273/81.3; 273/81 C; 273/81 D; 273/194 R; 273/77 R

[58] Field of Search ..... 273/193 R, 193 A, 193 B, 273/194 R, 165, 81.2, 81.3, 81 C, 81 D, 77 R, 81 R, 162 R

[56] References Cited

U.S. PATENT DOCUMENTS 3,533,630 10/1970 Lo Monaco ..... 273/81.3 X 4,252,317 2/1981 Vezina ..... 273/81.3 X 4,819,944 4/1989 Doane ..... 273/194 R X

*Primary Examiner*—George J. Marlo

*Attorney, Agent, or Firm*—Jack C. Munro

[57] ABSTRACT

An attachment for the hand of a human being to connect with the grasping end of a golf putter which will permit precise repeating pendulum movement of the putter. The attachment is to be removably connected to the putter so that the attachment can be released and the putter can be used in a conventional manner. The attachment includes a freely, pivotally mounted handle located on a shaft extending from an elongated clamping member which is longitudinally movable to clamp the grip of the putter within a housing in which the grip is received.

5 Claims, 1 Drawing Sheet

PENDULUM PUTTING DEVICE

BACKGROUND OF THE INVENTION

1) Field of the Invention

The field of this invention relates to golfing devices and more particularly to a device which is designed to improve the putting of a golf ball during the playing of the game of golf.

2) Description of the Prior Art

Golf is an exceedingly well known sport. A major part of golf is putting. Putting of a golf ball requires the highest degree of precision. This precision is accomplished by practice and if one wants to become a good putter a substantial amount of practice time is required with a correct putting stroke. There are a wide number of different types of putting strokes each of which are slightly different from each other. However, these putting strokes all have one common ingredient and that is the stroke is to be precisely repeated each and every time. Difficulty arises in achieving that precise repeating.

It is well-known that in conjunction with a human being the right portion of the human brain controls the left side of the human body and conversely the left portion of the brain controls the right side o the human body. The right-handed golfer has been extensively trained for left arm domination because it is the left arm that provides the power and strength and dominates in the control of the golf ball. However, in putting, left arm domination causes the ball to roll to the left of the hole. It has been found that this occurs about 70% of the time on putts that are 15 feet in length or longer. Ideally, during putting, left arm domination is to be eliminated with both arms being equally dominant. It is to be understood that for a left-handed golfer it is the right hand that dominates and the dominant right arm will cause propelling of the golf ball during putting to the right of the hole.

SUMMARY OF THE INVENTION

The structure of the present invention is designed to be utilized by a golfer during practice of the putting stroke to decrease or eliminate the domination of one particular arm during performing of the putting motion.

Another objective of the present invention is to provide an attachment whose purpose is to train the left portion of the brain (for a right handed putter) and the right portion of the brain (for a left handed putter) to take over some of the domination of the opposite side of the brain during the putting stroke.

The structure of the present invention constitutes an attachment which is to be attached on the free end of the grasping section of a putter. For a right handed player, the attachment provides a free floating left hand grip that adds nothing to the pendulum stroke of the putter thus allowing 100% right-hand control. The left portion of the brain has to function in order to perform the stroking of the putter which results in breaking free of the overwhelming domination of the left arm in conjunction with the putting stroke. The user is to hold the attachment steady with his or her left hand, generally against the user's left thigh. The user places his or her right hand on the grip portion of the putter and imparts a pendulum motion to the putter in contacting of the golf ball. The attachment includes a handle which is held by the left hand with this handle being freely pivotly mounted on a mounting shaft. The outer end of the mounting shaft includes a clamping member which is lineally movable within a clamp housing. The free end of the putter is to be located within the clamp housing and the clamping member is to be moved into tight engagement with this free end of the putter thereby securely fixing in position the clamp housing to the putter. The only movement now possible of the putter is a pendulum movement with the user grasping the handle.

DETAILED DESCRIPTION OF THE SHOWN EMBODIMENT

Figure 1:
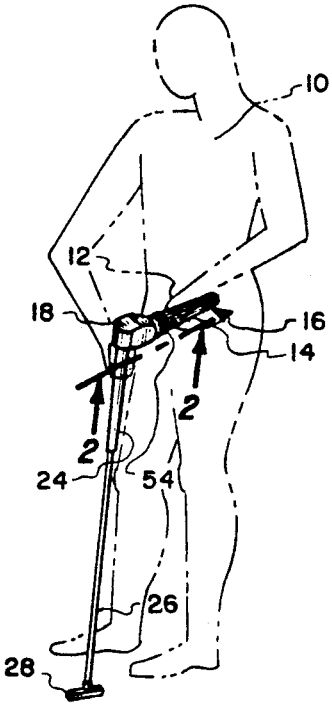
FIG. 1 shows the attachment of the present invention as it is to be used in conjunction with a putter and is depicted being held by a golfer.
Figure 5:
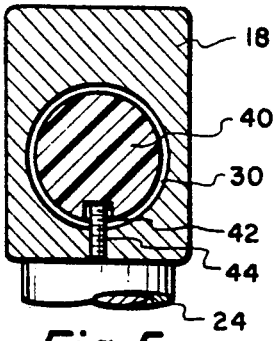
FIG. 5 is a cross-sectional view through a portion of the clamp housing included within the attachment of the present invention taken along line 5—5 of FIG. 3.
Figure 6:
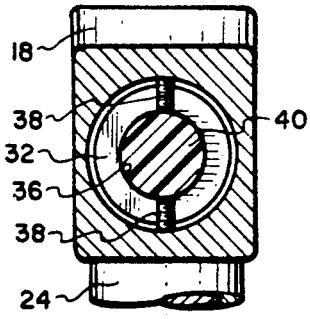
FIG. 6 is a cross-sectional view through another portion of the clamp housing included within the attachment of the present invention taken along line 6—6 of FIG. 3.

Referring particularly to the drawing, there is shown a golfer 10 whose left hand 12 is mounted around hollow sleeve handle 14 of the attachment 16 of the present invention. The attachment 16 includes a clamp housing 18 which has an enlarged internal recess 20. The free outer end 22 of the grip 24 of the putter shaft 26 of a putter is to be located within the recess 20. Putter shaft 26 terminates in an operating end which is defined by the putter head 28.

It is to be understood that although the structure of this invention is designed to be of particular advantage when utilized in conjunction with a putter, it is considered to be within the scope of this invention that the attachment of the present invention could be utilized in conjunction with any elongated implement where it is designed to produce a precisely repeating pendulum movement in conjunction with that implement.

Figure 7:
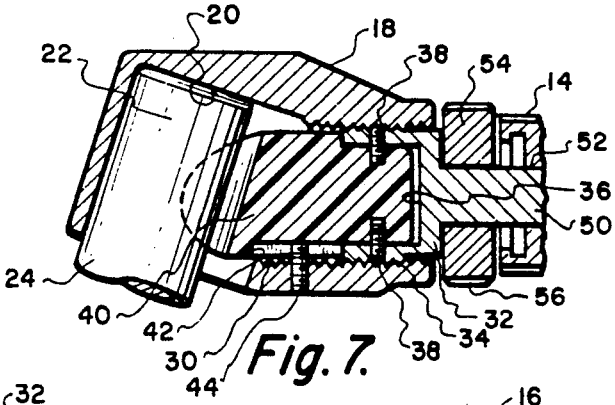
FIG. 7 is a view of the clamp housing of the attachment of the present invention similar to that of FIG. 3 but showing the clamping member within the clamp housing in the release position where within FIG. 3 the clamping member is shown engaging a grip having a smaller diameter.
Figure 2:
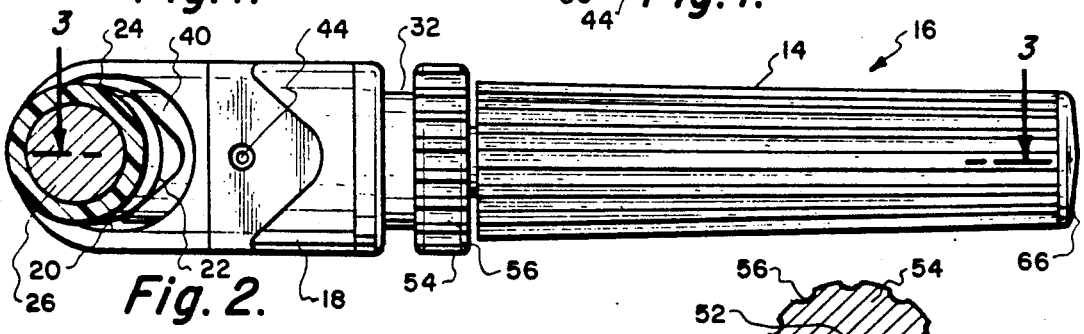
FIG. 2 is a bottom view of the attachment of the present invention taken in cross-section through the shaft of the putter taken along line 2—2 of FIG. 1.
Figure 4:
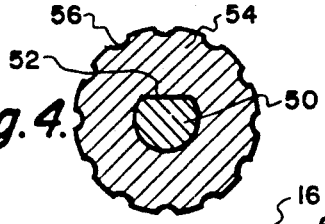
FIG. 4 is a transverse cross-sectional view taken along line 4—4 of FIG. 3.
Figure 3:
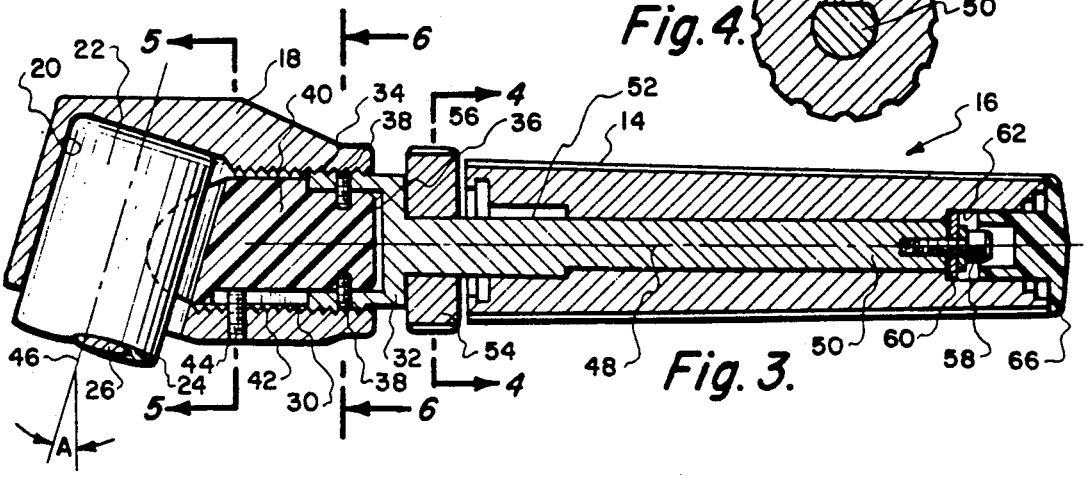
FIG. 3 is a longitudinal cross-sectional view of the attachment of the present invention taken along line 3—3 of FIG. 2 depicting more clearly the connection to the shaft of the putter.

The clamp housing 18 includes a through opening which has a wall surface formed into internal threads 30. A plug 32 includes a series of external threads 34. Threads 34 are to be engaged with threads 30. Plug 32 includes an internal recess 36 and fixedly mounted within the internal recess 36 by means of set screws 38 is a clamping member 40 which generally is constructed of plastic or other similar type of material. Clamping member 40 includes a slot 42. A set screw 44 is mounted through the wall of the clamp housing 18 and connects with the slot 42. It is a function of the set screw 44 to prevent the clamping member 40 from pivoting relative to the clamp housing 18 but does permit lineal movement of the clamping member 40 so that it can be moved into tight engagement with free end 22 as shown in FIG. 3 or can be moved to a further inward position to engage a smaller diameter free end 22 as is shown in FIG. 7.

It is to be noticed that when the grip 24 is mounted in the recess 20 that the longitudinal center axis 46 of the putter shaft 26 is inclined slightly away from vertical and does not form a right angle with the longitudinal center axis 48 of the mounting shaft 50. As a result the axis 46 is inclined at angle A from the right angle position in conjunction with the axis 48. A preferably number of degrees for angle A would be between 15 and 20 degrees. This particular angular relationship seems to be most comfortable for users of the attachment 16 of the present invention.

The mounting shaft 50 is fixedly mounted to the plug 32 and extends centrally outwardly therefrom. The portion of the shaft 50 which is located closest to the plug 32 includes a chamfered section 52. Connecting with the chamfered section 52 is an enlarged nut 54. The outer surface of the nut 54 includes a series of spaced apart grooves 56. It is the function of the grooves 56 to facilitate manual turning moving of the nut 54 since it is this manual turning motion that will cause threads 34 to rotate relative to threads 30. This in turn will result in plug 40 to be moved between the connection with the free outer end 22 of the putter and the release position as shown in FIG. 7. This nut 54 is to be utilized to tightly connect the plug 40 to the free outer end 22 when the user 10 desires to utilize the attachment 16 of the present invention.

The handle 14 is freely pivotally mounted on the mounting shaft 50. Longitudinal disengagement of the handle 14 from the shaft 50 is prevented by means of screw fastener 58 and washer assembly 60. The fastener 58 and washer assembly 60 rests within a recess 62 formed within the back end handle 14. Decorative cap 66 covers the recess 62.

I claim:

1. In combination with an elongated implement where it is desired for said implement to be manually swung in a precise repeating pendulum movement, said elongated implement having a first elongated center axis, said implement having an operating end and a grasping end which is opposite said operating end, an attachment comprising:

a clamp housing, an elongated clamping member longitudinally movably mounted on said clamp housing, said grasping end of said implement being adapted to tightly engage when said clamp housing with said clamping member is longitudinally moved into tight engagement with said grasping end thereby fixing said clamp housing to said implement;

a mounting shaft fixed to said clamping member, said mounting shaft having a second longitudinal center axis, said second longitudinal center axis being located transverse to said first longitudinal center axis; and a handle freely pivotly mounted on said mounting shaft, said handle to be grasped by the user and said implement to be swung in a pendulum motion with pivoting occurring between said mounting shaft and said handle.

2. The combination as defined in claim 1 wherein:

said clamping member being longitudinally movable to a release position permitting disengagement of said grasping end of said implement from said clamp housing.

3. The combination as defined in claim 1 wherein:

said clamp housing including an enlarged recess, said clamping member connecting with said enlarged recess, said grasping end to be located within said enlarged recess.

4. The combination as defined in claim 1 wherein:

an enlarged nut being mounted on said mounting shaft, said enlarged nut being fixed to pivot with said mounting shaft, said enlarged nut being mounted between said handle and said clamp housing, said enlarged nut having an exterior configuration of larger size than said handle.

5. The combination as defined in claim 1 wherein:

said transverse position of said second longitudinal center axis relative to said first longitudinal axis is approximately one hundred and ten degrees.

* * * * *